US009618892B2

(12) United States Patent
Tanaka

(10) Patent No.: US 9,618,892 B2
(45) Date of Patent: Apr. 11, 2017

(54) IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Norio Tanaka, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/340,526

(22) Filed: Nov. 1, 2016

(65) Prior Publication Data

US 2017/0045855 A1 Feb. 16, 2017

Related U.S. Application Data

(63) Continuation of application No. 13/863,737, filed on Apr. 16, 2013, now Pat. No. 9,513,590.

(60) Provisional application No. 61/625,034, filed on Apr. 16, 2012.

(51) Int. Cl.
*G03G 15/00* (2006.01)
*B41J 29/38* (2006.01)

(52) U.S. Cl.
CPC ..... *G03G 15/5012* (2013.01); *B41J 29/38* (2013.01)

(58) Field of Classification Search
None
See application file for complete search history.

(56) References Cited

U.S. PATENT DOCUMENTS

| | | | | |
|---|---|---|---|---|
| 5,781,822 | A * | 7/1998 | Nishiyama | G03G 21/00 399/1 |
| 8,260,188 | B2 | 9/2012 | Yahata et al. | |
| 2005/0141906 | A1 | 6/2005 | Murakami | |
| 2011/0234721 | A1 | 9/2011 | Endo | |
| 2012/0148327 | A1* | 6/2012 | Taki | B41J 2/32 400/695 |
| 2014/0192124 | A1 | 7/2014 | Arima | |

FOREIGN PATENT DOCUMENTS

| | | | |
|---|---|---|---|
| JP | H05270622 | A | 10/1993 |
| JP | H07319346 | A | 12/1995 |
| JP | 2007136675 | A | 6/2007 |

* cited by examiner

*Primary Examiner* — Blake A Tankersley
*Assistant Examiner* — Ruben Parco, Jr.
(74) *Attorney, Agent, or Firm* — Patterson & Sheridan, LLP

(57) ABSTRACT

According to embodiments, an image forming apparatus has a cassette section for holding sheets, a conveying section for conveying the sheet, an image forming section that forms the image on the sheet conveyed by the conveying section, a determining section that determines the type of the sheet fed from the cassette, and a display section that displays different messages corresponding to the type of the sheet if a jam of the sheet has occurred while the sheet is conveyed in the conveying section. The source of a sheet for printing thereon may be changed if a threshold number of paper jams occur using paper fed from a particular cassette.

11 Claims, 7 Drawing Sheets

FIG. 4

64a

| CASSETTE NO. | NUMBER OF JAM ROUNDS | THRESHOLD |
|---|---|---|
| 1 | 5 | 10 |
| 2 | 3 | 8 |

⋮

IMAGE FORMING APPARATUS

CROSS-REFERENCE TO RELATED APPLICATION

This application is a continuation of U.S. patent application Ser. No. 13/863,737, filed on Apr. 16, 2013, which is based upon and claims the benefit of priority from U.S. Provisional Patent Application No. 61/625,034 filed on Apr. 16, 2012; the entire contents of each of these applications are incorporated herein by reference.

FIELD

Embodiments described herein relate to an image forming apparatus.

BACKGROUND

In an image forming apparatus, when a paper jam occurs, the same message notifying the user of the paper jam (the recovery message or the error message) is displayed regardless of the type of the paper sheet that jammed.

DESCRIPTION OF THE DRAWINGS

FIG. 4 is a diagram illustrating an example of a configuration of a jam occurrence number management table stored in a nonvolatile memory of the multifunction peripheral according to the first embodiment.

DETAILED DESCRIPTION

In order to solve the problem, the present disclosure is directed to provide an image forming apparatus that carries out treatment corresponding to the type of the paper sheet that is in use.

According to embodiments of the present disclosure, the image forming apparatus has a cassette section for holding sheets, a conveying section for conveying the sheet, an image forming section that forms the image on the sheet conveyed by the conveying section, a determining section that determines the type of the sheet fed from the cassette, and a display section that displays different messages corresponding to the type of the sheet involved in a "paper jam" if a jam of the sheet has occurred as the sheet is conveyed in the conveying section.

In the following, a first embodiment will be explained in detail with reference to FIG. 1 through FIG. 5.

Figure 1:
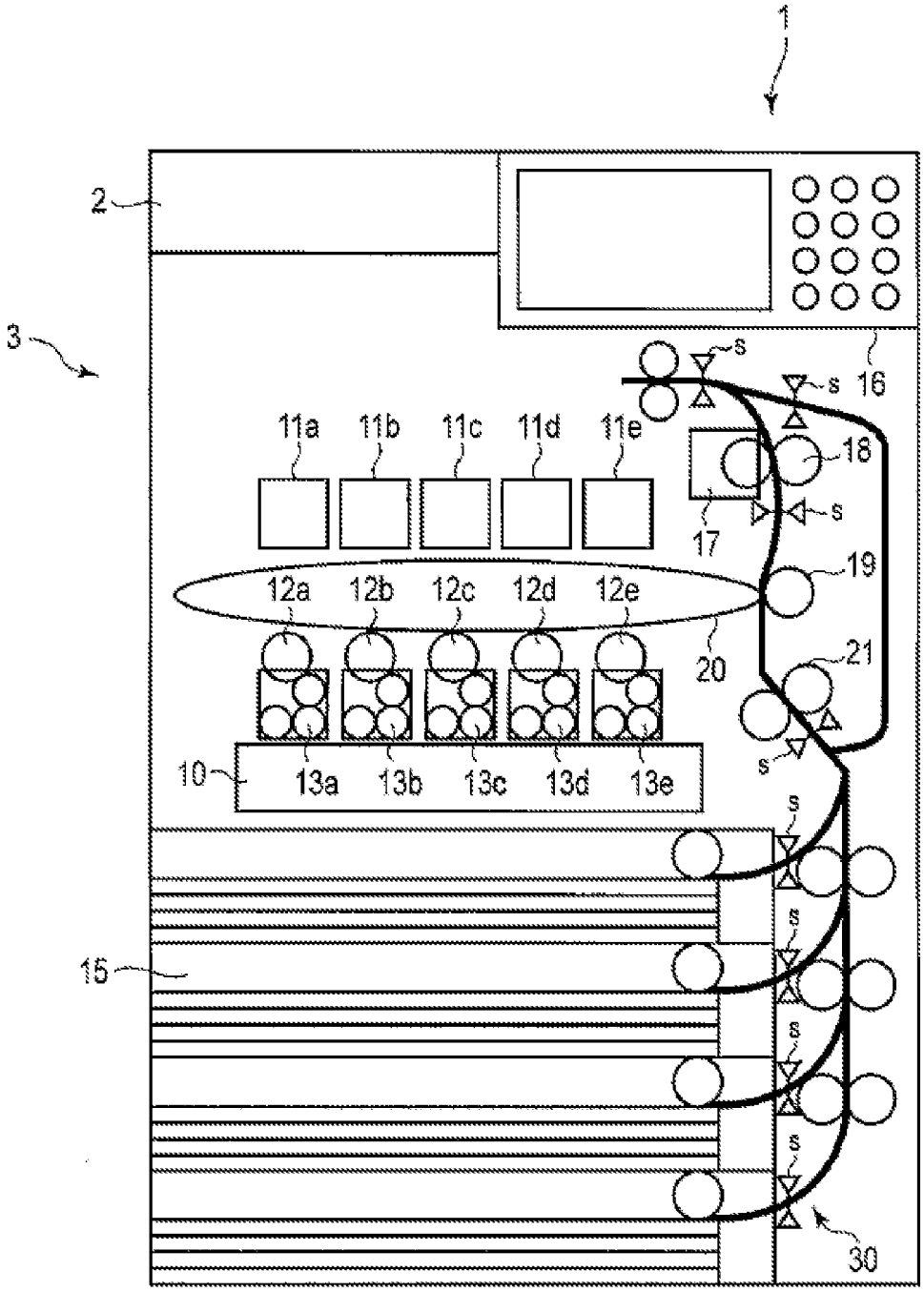
FIG. 1 is a schematic cross-sectional view illustrating an example of a configuration of a multifunction peripheral according to a first embodiment.

FIG. 1 is a cross-sectional view illustrating an example of an internal configuration of a multifunction peripheral (MFP) 1 according to the first embodiment.

As shown in FIG. 1, the MFP 1 has a scanner 2 and a printer 3 (an image forming apparatus). The scanner 2 works as follows: the surface of a document is optically scanned, and the image on the document is read as the color image data. The printer 3 forms an image on the basis of the color image data. In addition, as a unit for the input/output of the image data, the MFP 1 also has a fax interface (not shown in FIG. 1) for the transmission/reception of fax data or a network interface (not shown in FIG. 1) for network communication.

In the following, an example of the configuration of the printer 3 will be explained.

As shown in FIG. 1, the printer 3 includes an exposure section 10, first through fifth toner cartridges 11*a*-11*e*, first through fifth photoreceptor drums 12*a*-12*e*, first through fifth developing units 13*a*-13*e*, an operation panel 16, a fixing section 17, a fixing roller 18, a transcribing roller 19, a transcribing belt 20, a paper feeding section 30, and a plurality of sensors S.

In the exposure section 10, a laser beam is emitted for forming latent images on the first through fifth photoreceptor drums 12*a*-12*e* corresponding to colors in an image to be formed on a sheet. The first photoreceptor drum 12*a* holds the image formed from a yellow (Y) non-de-colorable toner (hereinafter conventional toner). The second photoreceptor drum. 12*b* holds the image formed from a magenta (M) conventional toner. The third photoreceptor drum 12*c* holds the image formed from a cyan (C) conventional toner. The fourth photoreceptor drum 12*d* holds the image formed from a black (K) conventional toner. The fifth photoreceptor drum 12*e* holds the image formed from a monochromic (e.g., black or blue colored) de-colorable toner (hereinafter de-colorable toner).

In the exposure section 10, laser beams are irradiated on the first through fifth photoreceptor drums 12*a*-12*e*. The beam irradiated on each of the photoreceptor drums 12*a*-12*e* corresponds to a color portion of an image to be formed on a sheet, respectively. The laser beam irradiated from the exposure section 10 forms electrostatic latent images on the first through fifth photoreceptor drums 12*a*-12*e*. The first through fifth photoreceptor drums 12*a*-12*e* hold the electrostatic latent images with each photoreceptor having a single color latent image thereon.

The first toner cartridge 11*a* holds a conventional yellow toner. The second toner cartridge 11*b* holds a conventional magenta toner. The third toner cartridge 11*c* holds a conventional cyan toner. The fourth toner cartridge 11*d* holds a conventional black conventional toner. The fifth toner cartridge 11*e* holds a de-colorable toner. The first through fifth toner cartridges 11*a*-11*e* feed the toners to the first through fifth developing units 13*a*13*e*, respectively.

The first through fifth developing units 13*a*-13*e* develop the images by feeding the toners to the electrostatic latent images held on the first through fifth photoreceptor drums 12*a*-12*e*, respectively. Specifically, the developing unit 13*a* develops the yellow toner image on the first photoreceptor drum 12*a* by feeding the yellow conventional toner thereto. The developing unit 13*b* develops the magenta toner image on the second photoreceptor drum 12*b* by feeding the magenta conventional toner thereto. The developing unit 13*c* develops the cyan toner image on the third photoreceptor drum 12*c* by feeding the cyan conventional toner thereto. The developing unit 13*d* develops the black toner image on the fourth photoreceptor drum 12*d* by feeding the black conventional toner thereto. The developing unit 13*e* develops the de-colorable toner image on the fifth photoreceptor drum 12*e* by feeding the de-colorable toner thereto.

As used herein, de-coloring, de-colorable, etc. are used to describe a developer which may switch from displaying a color which is visible to the human eye to one which is substantially invisible, and hence "erased", although the developer remains in-situ on the sheet. Color is used to mean indicia such as the RGB color spectra, as well as black and white.

The transcribing belt 20 is an intermediate transcribing member. The first through fifth photoreceptor drums 12*a*-12*e* carry the toner images that will be transcribed to the transcribing belt 20, respectively. The paper feeding section 30 has a plurality of cassettes 15 and a resist roller 21. The resist roller 21 feeds the paper sheet to the transcribing roller 19 in accordance with the timing of transcribing the toner image on the transcribing belt 20 to the paper sheet.

The cassettes 15 hold the paper sheets used for image forming media. The cassettes 15 can accommodate a prescribed number of paper sheets of different sizes. A single cassette 15 can accommodate either new paper sheets or reusable used paper sheets (reuse paper sheets).

The resist roller 21 feeds the paper sheet to the transcribing roller 19 so that the feeding timing matches the timing of transcribing of the toner image on the transcribing belt 20 to the paper sheet by the transcribing roller 19.

The fixing section 17 fixes the toner image transcribed on the paper sheet by the transcribing belt 20. The fixing section 17 conveys the fixed paper sheet to a conveying section 47.

The operation panel 16 can display various types of information to the user of the MFP 1 based on a command from the control section of the MFP 1. For example, when a paper jam occurs, the operation panel 16 displays an error message (a message that a paper jam has occurred) and a recovery message (the method for handling the paper jam), and the like. The user can determine the format of the printing at the operation panel 16, because the operation panel 16 transmits information input by the user to the control section. For example, the user can determine or select the size of the paper sheet for printing at the operation panel 16. Also, the user can use the operation panel 16 to determine whether a new paper sheet or a reusable used paper sheet should be used for printing. In addition, the operation panel 16 may be a liquid crystal panel and have operation touch selection capability. Alternatively, the operation panel 16 may be a touch panel or the like.

The sensor S detects a paper jam. When the paper jam is detected by the sensor S, a paper jam detection signal is sent to the control section. The MFP 1 has a plurality of sensors S arranged along the paper conveying paths in locations where the paper sheet will pass. For example, the MFP 1 has the sensors S arranged at the periphery of the conveying rollers such as the transcribing roller 19, the fixing roller 18, and the resist roller 21. The sensors S are connected to the control section. The control section receives the paper jam detection signal from the sensor S. Consequently, the control section can recognize that a paper jam occurred and the location in the sheet feeding path where paper jam exists.

In the following, another MFP 1' according to the first embodiment will be explained.

Figure 2:
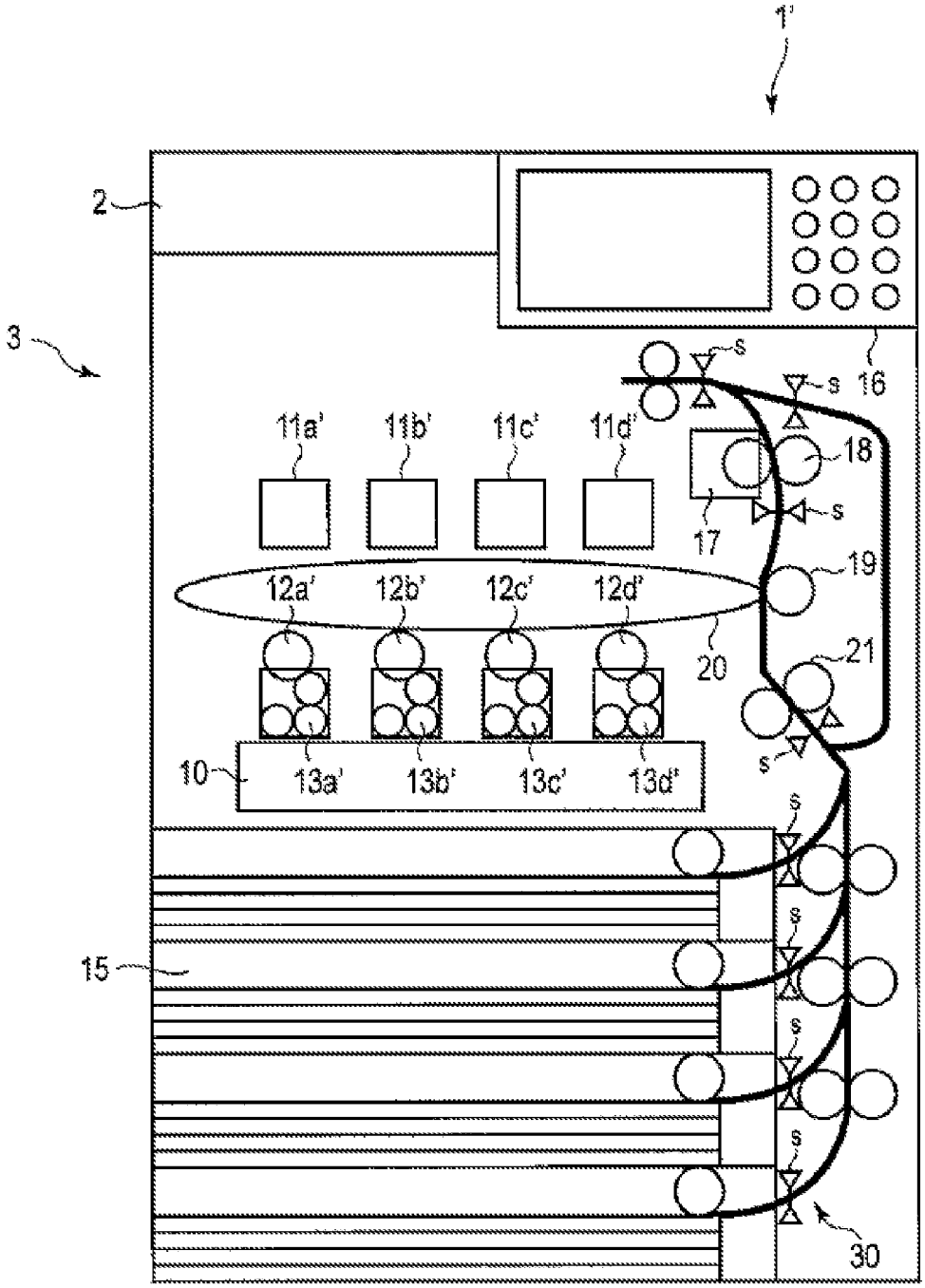
FIG. 2 is a schematic cross-sectional view illustrating an example of a configuration of another multifunction peripheral according to the first embodiment.

FIG. 2 is a cross-sectional view illustrating an example of the internal configuration of another MFP 1' according to the first embodiment.

The MFP 1' shown in FIG. 2 has a different number of toners from the number of toners used in the MFP 1 shown in FIG. 1. The MFP 1' shown in FIG. 2 adopts the same reference numbers as those in the MFP 1 shown in FIG. 1 to represent the same components, so that the explanation for those components is not repeated herein.

In MFP 1', the first through third toner cartridges 11*a*'-11*c*', the first through third photoreceptor drums 12*a*'-12*c*', and the first through third developing units 13*a*'-13*c*' are disposed to form a color image by using conventional toners. Here, the first through third toner cartridges 11*a*'-11*c*' hold a yellow conventional toner, a magenta conventional toner and a cyan conventional toner, respectively. The first through third photoreceptor drums 12*a*'-12*c*' carry latent images to form a toner image from the yellow conventional toner, the magenta conventional toner and the cyan conventional toner, respectively. The first through third developing units 13*a*'-13*c*' develop the electrostatic latent images on the first through third photoreceptor drums 12*a*'-12*c*' using the yellow conventional toner, the magenta conventional toner and the cyan conventional toner, respectively.

In addition, in the MFP 1', a fourth toner cartridge 11*d*', a fourth photoreceptor drum. 12*d*', and a fourth developing unit 13*d*' are disposed to form an image using a de-colorable toner. The fourth toner cartridge 11*d*' holds a monochromic (black or blue) de-colorable toner. The fourth photoreceptor drum 12*d*' holds the latent image to form a toner image formed from a de-colorable toner. The fourth developing unit 13*d*' develops the electrostatic latent image formed on the fourth photoreceptor drum 12*d*' by using the de-colorable toner.

The present embodiment can be used in a printer that uses a de-colorable toner to form the image. In the above-mentioned examples, the printer 3 of MFP 1 (or MFP 1') has a structure to form an image by using a conventional toner. However, the structure required to form the image formed of the conventional toner may be omitted.

In the following, the configuration of the control system (control section) of the MFP 1 will be explained.

Figure 3:
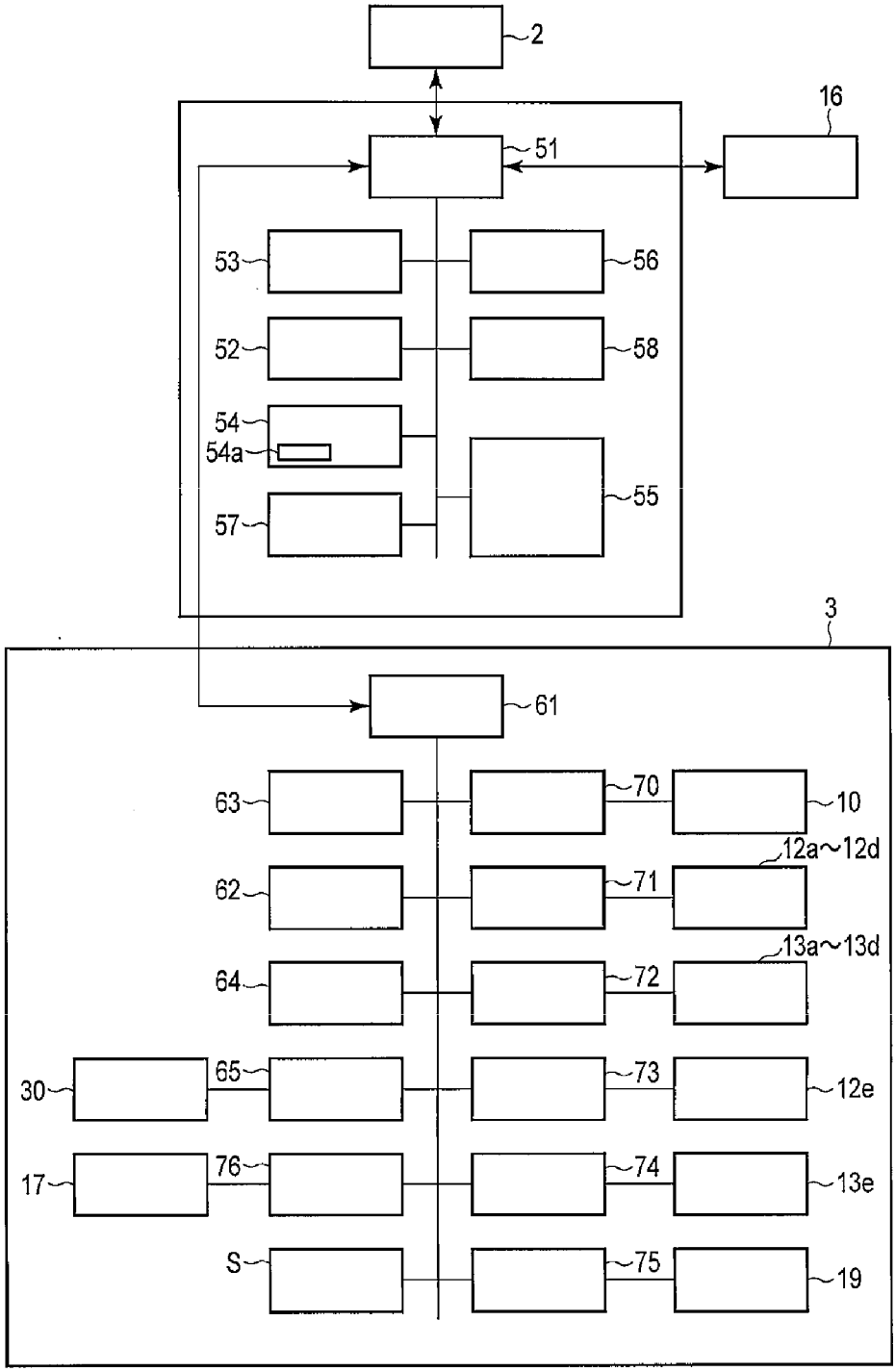
FIG. 3 is a block diagram illustrating an example of a configuration of a control system in the multifunction peripheral according to the first embodiment.

FIG. 3 is a block diagram illustrating an example of the configuration of the control system in the MFP 1. The MFP 1' shown in FIG. 2 can be controlled by the control system shown in FIG. 3.

In the example of the control system shown in FIG. 3, the control section has a system CPU (processor) 51, a RAM 52, a ROM 53, a nonvolatile memory (NVM) 54, a HDD 55, a page memory 56, an external interface (I/F) 57, and an image processing section 58.

The system CPU 51 performs overall control of the MFP 1 and the individual sections of the MFP 1. The system CPU 51 is a processor that can control the operations of the MFP 1 by executing control programs. The system CPU 51 is connected to the components in the MFP 1 via system buses. In addition to the components in the control section, the system CPU 51 is also connected via a system bus to the scanner 2, the printer 3, the operation panel 16, and the like. By two-way communication with the scanner 2, the printer 3, and the operation panel 16, the system CPU 51 outputs the operation instructions to the MFP components and can acquire various types of information from these components. Here, the system CPU 51 receives, from the sensors disposed at several points in the apparatus, the signals detected by the sensors and information indicating the operational state of the apparatus.

The RAM 52 is a volatile memory. Here, the RAM 52 is a working memory or a buffer memory. The ROM 53 is a non-rewritable nonvolatile memory for storing the control programs and control data, and the like. The system CPU 51 carries out various types of treatments by executing the control programs stored in the ROM 53 (or the nonvolatile memory 54 or the HDD 55) while using the RAM 52. For example, the system CPU 51 can execute control programs to play a role of an extracting means, a control means, and the like.

The nonvolatile memory (NVM) 54 is a rewritable nonvolatile memory. The nonvolatile memory 54 stores the control programs and the control data for execution by the system CPU 51. Also, the nonvolatile memory 54 stores preset information and operation conditions, and the like.

The NVM 54 has a recording region 54*a* that holds the jam occurrence number management table. The jam occurrence number management table will be discussed in detail later.

The hard disk device (HDD) 55 is a high-capacity memory device. The HDD 55 stores the image data and various types of history information. In addition, the HDD 55 may also store the control programs, the control data, and the like. The HDD 55 may also store the preset information and the operation conditions, and the like. The HDD may also have a recording region for accommodating the jam occurrence number management table.

The page memory 56 is a memory that develops the image data.

The external interface (I/F) 57 is an interface for communicating with external equipment or devices. For example, the external interface 57 may be an interface locally connecting the external device. The external interface may also be a network interface.

The image processing section 58 has an image processing section for a scanner system that interprets the image read by the scanner 2, a compression/extension section that carries out the compression/extension of the image data, an image processing section for the printer system that generates the image data for printing by the printer 3 on a paper sheet, and the like.

In the following, an example of the configuration of the control system in the printer 3 will be explained.

In the example of the control system shown in FIG. 3, the printer 3 has the following components of the control system: a printer CPU (processor) 61, a RAM 62, a ROM 63, a nonvolatile memory (NVM) 64, drivers 65 and 70-76.

The printer CPU 61 controls the printer 3 operation. The printer CPU 61 is a processor that controls the operations of the printer 3 by executing control programs. The printer CPU 61 is connected via the system bus, and the like, to the various sections in the printer 3. Using operational instruction received from the system CPU 51, the printer CPU 61 outputs the operational instructions to the various sections in the printer 3 or sends information acquired from the sections to the system CPU 51.

The RAM 62 is made of a volatile memory. The RAM 62 is a working memory or a buffer memory. The ROM 63 is a non-rewritable nonvolatile memory that stores the control programs, control data, and the like. While using the RAM 62, the printer CPU 61 carries out various types of operations by executing the control programs stored in the ROM 63 (or the nonvolatile memory 64).

The nonvolatile memory (NVM) 64 is a rewritable nonvolatile memory. For example, the NVM 64 stores the control programs and the control data to be executed or used by the printer CPU 61. Also, the NVM 64 stores the preset information, the operation condition, and the like.

The driver 65 controls the driving of the paper feeding section 30 using the operational instruction of the printer CPU 61. Thus, the paper feeding section 30 is driven according to the driving signal from the driver 65. For example, the paper feeding section 30 feeds the paper sheets from the cassettes 15 according to the driving signal from the driver 65.

Using the operational instruction from the printer CPU 61, the driver 70 controls the driving of the exposure section 10. The exposure section 10 works under the control of a driving signal from the driver 70 to form electrostatic latent images on the first through fifth photoreceptor drums 12*a*-12*e*. For example, corresponding to the image data instructed by the printer CPU 61, the driver 70 controls the laser beam irradiating on the first through fifth photoreceptor drums 12*a*-12*e* in the exposure section 10.

The driver 71 controls the driving of the photoreceptor drums 12*a*-12*d*. The driver 72 controls the driving of the developing units 13*a*-13*d*. The developing units 13*a*-13*d* use the conventional toners to develop the electrostatic latent images on the photoreceptor drums 12*a*-12*d* according to the driving signal from the driver 72.

The printer 73 controls the driving of the fifth photoreceptor drum 12*e*. The driver 74 controls the driving of the developing unit 13*e*. The developing unit 13*e* uses the de-colorable toner to develop the electrostatic latent image on the fifth photoreceptor drum 12*e* under the driving signal from the driver 74.

The driver 75 controls the driving of the transcribing roller 19 using operational instructions from the printer CPU 61. Thus, the transcribing roller 19 is driven by the driving signal from the driver 75. According to the driving signal from the driver 75, the transcribing roller 19 transcribes the toner image transcribed on the transcribing belt 20 to the paper sheet.

The driver 76 controls the driving of the fixing section 17 using the operational instructions received from the printer CPU 61. Thus, the fixing section 17 is driven by the driving signal from the driver 76.

In the following, the jam occurrence number management table will be explained.

The recording region 54*a* in the NVM 54 accommodates the jam occurrence number management table 54*a*. The jam occurrence number management table 54*a* is a table that records how many times a paper jam has occurred while the reusable used paper sheets are in use.

FIG. 4 is a diagram illustrating an example of the configuration of the jam occurrence number management table 54*a*.

The jam occurrence number management table 54*a* accommodates the sheet source cassette No., the jam occurrence number, and a threshold, which are stored to corresponding to each other.

The cassette number (the left column in FIG. 4) is the identification number for identifying the cassette 15 in which the reusable used paper sheet is accommodated and from where it was pulled for printing. For example, the cassette with cassette No. "1" in FIG. 4 is a cassette primarily used when the reusable used paper sheets are used for the print job.

The jam occurrence number is counted, i.e., moved to the next whole number, by a number counter when a jam of the reusable used paper sheet occurs in the MFP 1 while using a reusable paper sheet fed from the cassette of the corresponding cassette number. Here, the jam occurrence number is a number showing how many times a jam of are usable used paper sheet occurs while the reusable used paper sheets are in use. For example, in the example shown in FIG. 4, the jam occurrence number management table 54*a* indicates that a jam of the reusable used paper sheets accommodated in the cassette of the cassette No. "1" has occurred five times The "threshold" (the right column in FIG. 4) refers to the jam occurrence number permissible by the MFP 1. Thus, the threshold is a number of how many times a jam of the reusable used paper sheets is permitted to occur with respect to a specific source cassette. For example, in the example shown in FIG. 4, the jam occurrence number management table 54*a* permits up to 10 paper jams for the reusable used paper sheets accommodated in the cassette of No. "1". If the jam occurrence number is more than the threshold, the MFP 1 carries out a predetermined operation. For example, the MFP 1 can indicate an error message that the paper jam occurs, which is a different error message from a conventional error message (a general error message), or can display another error message in addition to the conventional error message.

In addition, the different cassettes may have a different threshold, or the different cassettes may have the same threshold. There is no specific restriction on the threshold for each cassette, and the threshold may be pre-set, or user settable . . . .

In the following, an example of a printing operation of the printer 3 will be explained.

The system CPU 51 instructs the printer CPU 61 to start the printing operation and assigns the printer CPU 61 the cassette number from which to source the paper for printing operation (i.e., the cassette 15 from which the paper sheet should be fed). The printer CPU 61 starts the printing operation using the instructions from the system CPU 51. If the printer CPU 61 receives the instruction for printing from the system CPU 51, then the printer CPU 61 causes a paper sheet to be fed from the selected cassette 15. The printer CPU 61 conveys the paper sheet along the paper conveying paths in the printer 3.

During the printing operation, the printer CPU 61 determines whether a paper jam occurs. For example, the printer CPU 61 uses the sensors S disposed at several points in the printer 3 to detect a paper jam. When a paper jam is detected, on the basis of the detection signal by sensor S in the printer 3, the printer CPU 61 identifies the location where the paper jam occurs. When the location of the paper jam is identified, the printer CPU 61 sends the information indicating the occurrence of a paper jam and the location at which the paper jam occurred to the system CPU 51.

The system CPU 51 receives the information indicating the occurrence of a paper jam and the location of the paper jam from the printer CPU 61. When the two pieces of information are received, the system CPU 51 commands the operation panel 16 to display the error message indicating the occurrence of a paper jam, the method to address the paper jam, and the like.

Also, when the paper sheet that has jammed is a reusable used paper sheet, the system CPU 51 displays a message indicating that a jam of a reusable used paper sheet occurred, in addition to the conventional error message on the operation panel 16.

In addition, when the paper sheet that has jammed is a reusable used paper sheet, the system CPU 51 counts how many times the paper jam occurs with respect to a corresponding cassette number. When the jam occurrence number is more than a prescribed threshold, the system CPU 51 also displays a message that the paper jam has occurred more than permissible times with respect to the cassette, on the operation panel 16 display, in addition to the message that a jam of the reusable used paper sheet occurred.

In the following, an example of the operation of the system CPU 51 will be explained in detail.

Figure 5:
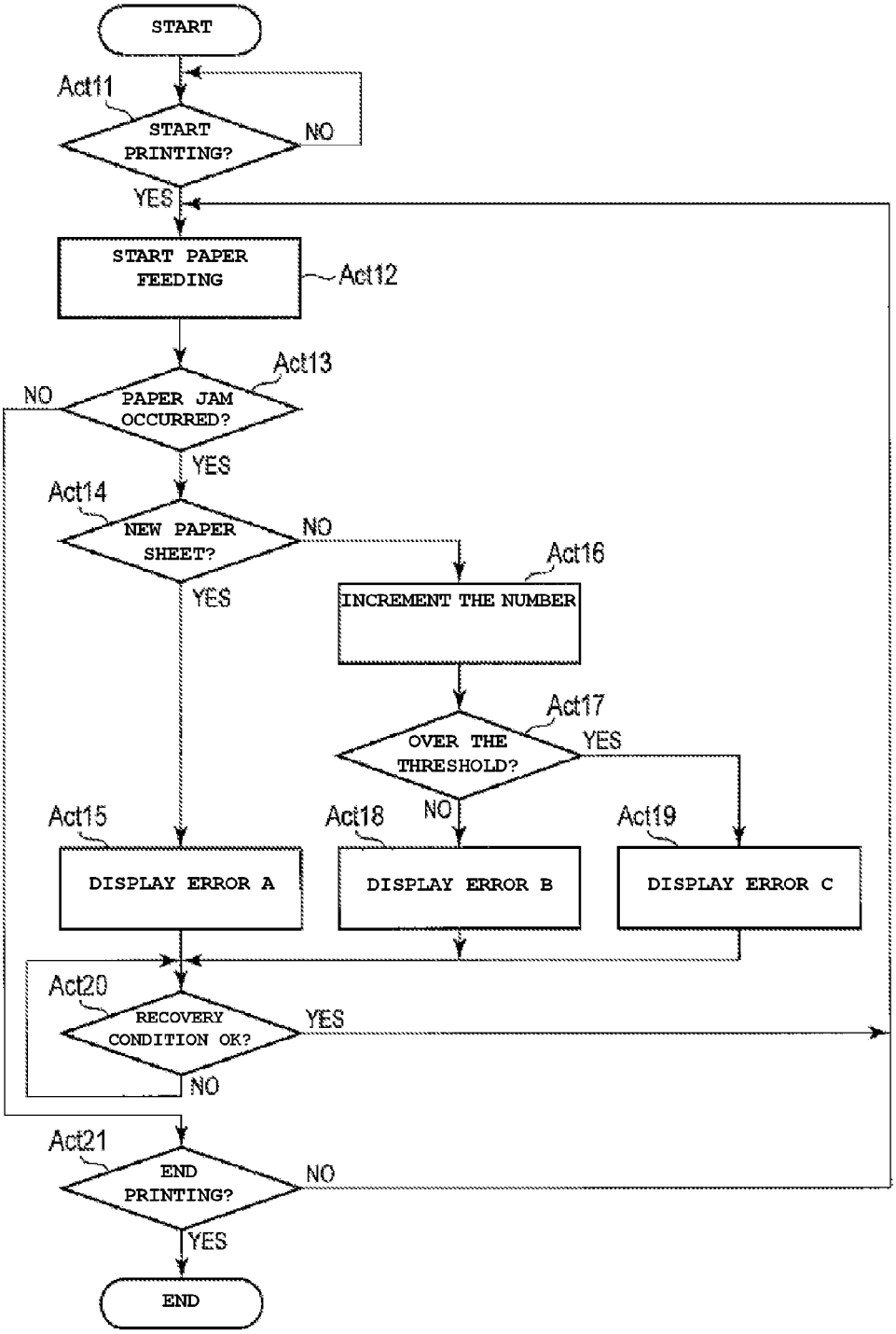
FIG. 5 is a flow chart illustrating an example of an operation of the multifunction peripheral according to the first embodiment.

FIG. 5 is a flow chart illustrating an example of the operation of the system CPU 51.

First, the system CPU 51 determines whether starting of a print job is requested to (Act 11). For example, the system CPU 51 determines whether starting a print job is requested based on an instruction to printing being input into the operation panel 16. Also, the system CPU 51 determines whether starting a print job is requested from an external device (e.g., PC), which is received from the external I/F 57.

If the system CPU 51 determines that no print job is requested to start (NO in Act 11), the operation returns to step Act 11, and the system CPU 51 waits for the request for starting a print job.

If the system CPU 51 determines that a print job is requested (YES in Act 11), the system CPU 51 commands the paper feeding section 30 to start feeding the paper sheets (Act 12). Thus, based on the request for starting a print job, the system CPU 51 decides the size of the paper sheets to be fed and decides the cassette 15 from which the paper sheets are to be fed. For example, the system CPU 51 decides the size of the paper sheet based on a selection by the user of the MFP 1. The MFP 1 may also adopt a scheme in which the system CPU 51 decides the size of the paper sheet based on the size of the image data to be printed.

Also, the system CPU 51 selects the cassette 15 from which the paper sheet is to be fetched based on the desired size of the paper sheet. In order to do so, the system CPU 51 recognizes the sizes of the paper sheets held in the cassettes 15. For example, the NVM 54 stores the setting information regarding the type/size of the paper sheets held in each cassette 15. According to the setting information, the type/size of the paper sheets accommodated in each cassette 15 is recognized by the system CPU 51. Also, the system CPU 51 may recognize the size of the paper sheets accommodated in each cassette 15 according to a selection by the user.

After the cassette 15 from which the paper sheet is to be fetched is decided, the system CPU 51 instructs the printer CPU 61 to start printing, and, at the same time, the system CPU 51 provides instruction regarding the selected cassette 15.

After the system CPU 51 instructs the start of a print job, the system CPU 51 determines whether a paper jam has occurred in the printer 3 (Act 13). Based on the information received from the printer CPU 61 (the information regarding the occurrence of paper jam and the location of the paper jam), the system CPU 51 recognizes the occurrence of a paper jam.

If the system CPU 51 recognizes that a paper jam has occurred (YES in Act 13), the system CPU 51 determines whether the jammed paper sheet is a new paper sheet (Act 14). Alternatively, the system CPU 51 determines whether the paper sheet assigned by the user is the reusable used paper sheet.

The MFP 1 may adopt a scheme in which the system CPU 51 determines whether the paper sheet is the reusable used paper sheet based on the type of the toner selected by the user. Specifically, the system CPU 51 determines that the paper sheet is a reusable used paper sheet if the de-colorable toner is selected by the user. This is because, if the user selects the de-colorable toner for the print job, the cassette 15 corresponding to the de-colorable toner commonly holds the used paper sheets.

The MFP 1 may also adopt a scheme in which the system CPU 51 uses sensors, and the like, to determine whether the paper sheet is the reusable used paper sheet. Specifically, the system CPU 51 may use a scanner or other sensors to detect for traces of the de-colorable toner on the paper sheet. In order to distinguish the reusable used paper sheets from ordinary (new) paper sheets, a mark may be printed at the prescribed area of a paper sheet with respect to only the reusable used paper sheet. In this case, the system CPU 51 determines whether the paper sheet is a reusable used paper sheet based on whether the mark is detected. Here, how the system CPU 51 determines that the paper sheet is a reusable used paper sheet is not restricted.

If the system CPU 51 determines that the jammed paper sheet is a new paper sheet (YES in Act 14), the system CPU 51 commands the operation panel 16 to display an error message A (Act 15). The error message A is an error message indicating that a new paper sheet has jammed. Thus, the error message A is an error message displayed when a conventional paper jam has occurred. For example, the error message A is a message that a paper jam has occurred, the location at which the paper jam has occurred, and the method to resolve the paper jam.

If the system CPU 51 determines that the jammed paper sheet is not a new paper sheet (NO in Act 14), in addition to the actions taken when a new sheet jams, the system CPU 51 increments the jam occurrence number (Act 16). Thus, the system CPU 51 counts up the jam occurrence number corresponding to the cassette number of the cassette 15 in the jam occurrence number management table 54*a*. For example, if a paper fed from a cassette of No. "1" holding used paper jammed, the system CPU 51 increases the jam occurrence number corresponding to the cassette of No. "1" from "5" to "6."

As the jam occurrence number is incremented, the system CPU 51 determines whether the jam occurrence number is more than the threshold (Act 17). Thus, the system CPU 51 determines whether the jam occurrence number corresponding to a specific cassette number is more than the threshold corresponding to the cassette number. For example, the system CPU 51 determines whether the jam occurrence number corresponding to the cassette No. "1" is more than 10.

If the system CPU 51 determines that the jam occurrence number is not over the threshold (NO in Act 17), the system CPU 51 commands the operation panel 16 to display an error message B on it (Act 18). Here, the error message B is a message that the jammed paper sheet is a reusable used paper sheet. The error message B may also include information included in the error message A. Also, the error message B may include information regarding the method for handling the jammed reusable used paper sheet. The contents of the error message B are not restricted as long as the message includes that the jammed paper sheet is a reusable used paper sheet.

If the system CPU 51 determined that the jam occurrence number is over the threshold (YES in Act 17), the system CPU 51 commands the operation panel 16 to display an error message C on it (Act 19). The error message C may include a message that the jam occurrence number is more than the threshold number. In addition, the error message C may include the error message B. Further, the error message C may include a message that suggests the user select another cassette 15 other than the cassette 15 in which the paper sheet that has caused the jam was stored. Also, the error message C may include a message that suggests the user replace the paper sheets in the cassette 15 in which the paper sheet that has caused the jam was stored. The contents of the error message C are not restricted.

If the error message A, the error message B, or the error message C is displayed on the operation panel 16, the system CPU 51 determines whether the condition for the recovery from the paper jam state has been met (Act 20). Thus, the system CPU 51 determines whether a condition appropriate to resume a print job is met, i.e., a state in which the jammed paper sheet has been removed.

If the system CPU 51 determines that the condition for the recovery from paper jam is not met (NO in Act 20), the system CPU 51 returns to Act 20, and the system CPU 51 waits until the condition for the recovery is met.

If the system CPU 51 determines that a paper jam did not occur (NO in Act 13), then the system CPU 51 determines whether the printing ends (Act 21). Thus, the system CPU 51 determines whether information indicating the end of printing has been received without receiving from the printer CPU 61 the information indicating that an error occurred.

If the system CPU 51 determined that printing has not ended (NO in Act 21), or if the system CPU 51 determines that the recovery condition from the paper jam has been met (YES in Act 20), the system CPU 51 returns to Act 12 to resume printing.

If the system CPU 5 determines that the printing has ended (YES in Act 21), the system CPU 51 ends the printing operation.

Also, the following schemes may also be adopted. Thus, if the ratio of the jam occurrence number with respect to the number of print jobs is above a prescribed value, the system CPU 51 may command the operation panel 16 to display the error message C on it (even if the jam occurrence number is not above the threshold). Further, if the ratio corresponding to a specific cassette is more than the ratio corresponding to another cassette, the system CPU 51 may command the operation panel 16 to display the error message C on it.

With the above-mentioned configuration, the image forming apparatus can display an error message different from the conventional error message when the jammed paper sheet is the reusable used paper sheet. In addition the image forming apparatus can display, a message notifying the user of the identity of the cassette that tends to cause paper jams.

In the following, the second embodiment will be explained.

The MFP in the second embodiment has the same configuration as that of the MFP 1 according to the first embodiment.

In the following, the operation of the printer 3 according to the second embodiment will be explained.

The transmission of the instruction for printing by the system CPU 51 to the printer CPU 61 and the transmission of the information regarding the paper jam and the location of the paper jam from the printer CPU 61 to the system CPU 51 are the same as those in the first embodiment. In addition, as the system CPU 51 receives the two pieces of information, the system CPU 51 displays the error message that a paper jam has occurred and the method for handling the paper jam on the operation panel 16. This is also the same as that in the operation in the first embodiment.

If the jammed paper sheet is a reusable used paper sheet, the system CPU 51 counts the jam occurrence number corresponding to the cassette 15 that has accommodated the jammed paper sheet. If the jam occurrence number is over the prescribed threshold, the system CPU 51 commands a paper feeding section 30 to feed a paper sheet of the same size as the jammed paper sheet from another cassette 15 if another cassette has the same size sheet loaded therein. At the same time, the system CPU 51 commands the operation panel 16 to display information that the cassette from which the paper sheet was fed has been changed.

If no cassette 15 accommodates the paper sheets with the same size as that of the jammed paper sheets and its jam occurrence number has reached a prescribed threshold, the system CPU 51 commands the operation panel 16 to display information that the jam occurrence number is over the threshold.

In the following, an example of the operation of the system CPU 51 will be explained in detail.

Figure 6:
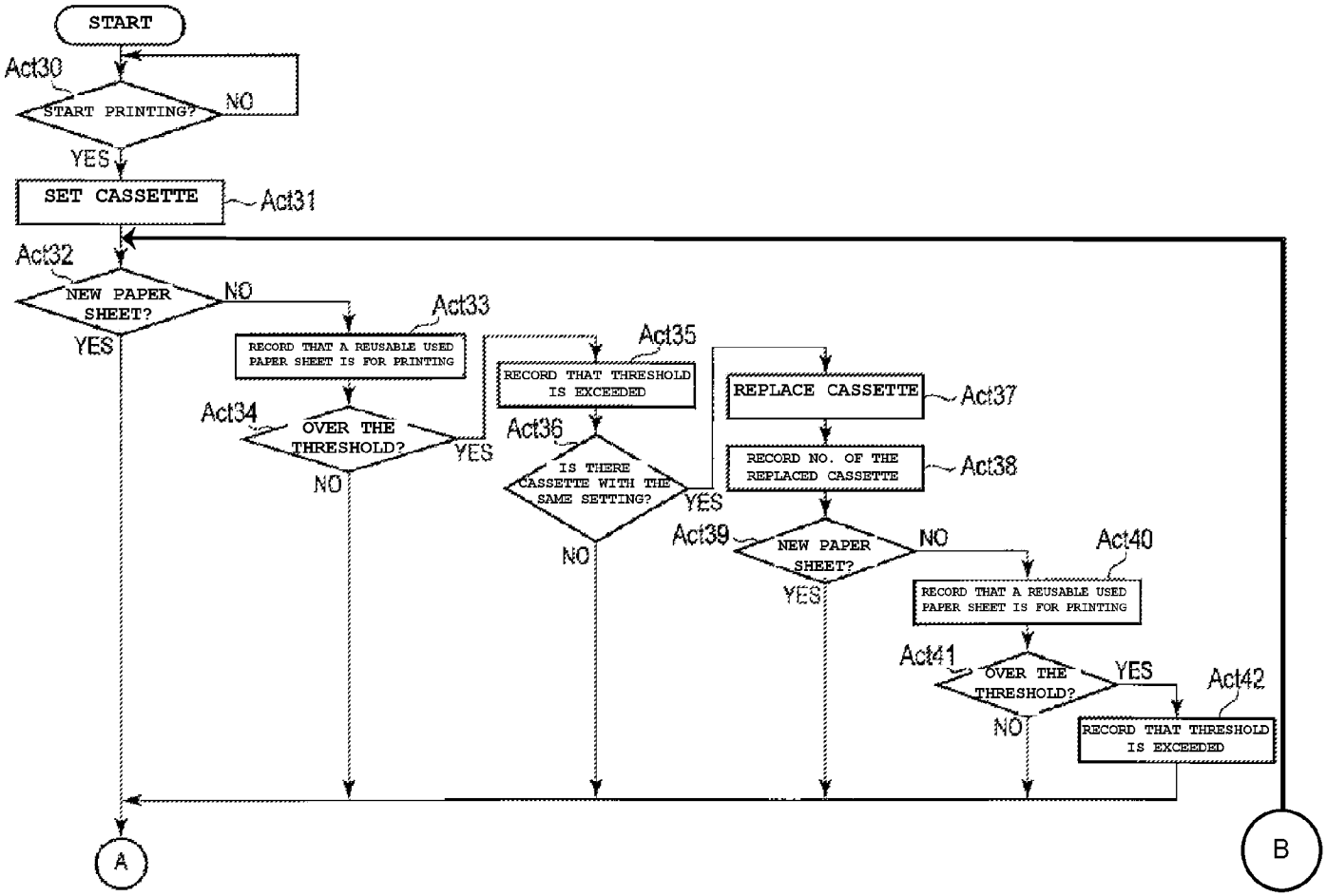
FIG. 6 is a flow chart illustrating an example of an operation of the multifunction peripheral according to a second embodiment.
Figure 7:
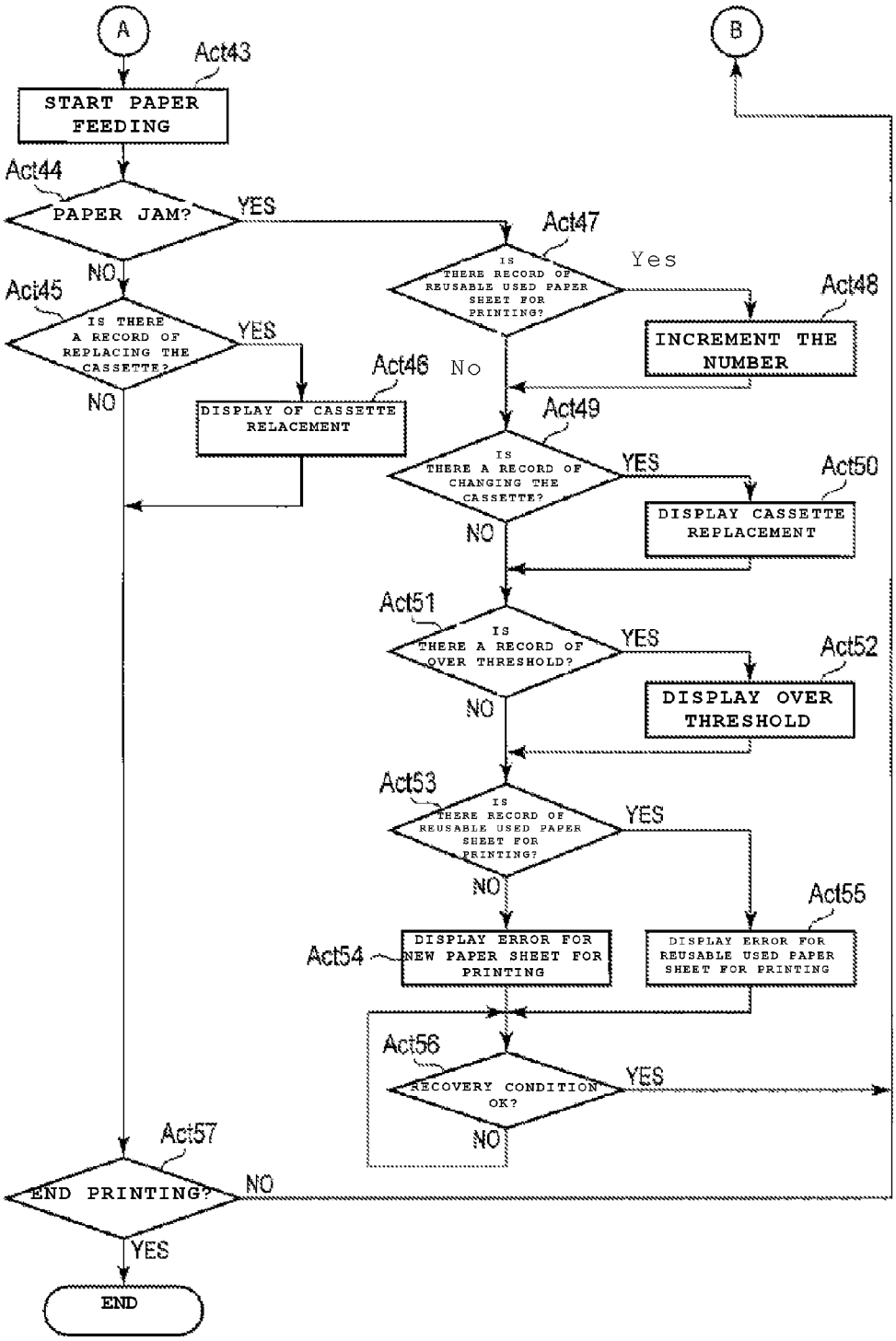
FIG. 7 is a flow chart illustrating an example of an operation of the multifunction peripheral according to the second embodiment.

FIGS. 6 and 7 are flow charts illustrating the operation of the system CPU 51.

First, the system CPU 51 determines whether starting of a print job is requested (Act 30). The operation of Act 30 is the same operation as that in Act 11 in the first embodiment.

When the system CPU 51 determinations that no print job is requested to start (NO in Act 30), the system CPU 51 returns to Act 31, and the system CPU waits for instruction to restart printing.

When the system CPU 51 determines that a print job is requested to start (YES in Act 30), the system CPU 51 determines the cassette 15 from which the paper sheets used for the print job are to be fetched (Act 31). For example, the system CPU 51 determines the size of the paper sheet to be used for the print job based on an instruction by the user of the MFP 1. Also, the system CPU 51 may decides the size based on the size of the image data to be printed. Once the size of the paper sheet is determined, the system CPU 51 selects the cassette 15 from which the paper sheet is to be fetched based on the determined type and size. The selection method is the same as mentioned previously.

If the cassette 15 is selected, the system CPU 51 determines whether the paper sheet used for the print job is a new paper sheet (Act 32). Alternatively, the system CPU 51 may determine whether the paper sheet selected by the user is a reusable used paper sheet.

The following scheme may be adopted. The system CPU 51 may determine whether the paper sheet is the reusable used paper sheet based on the type of the toner selected by the user. Specifically, if the user selects the de-colorable toner, the system CPU 51 assumes that the paper sheet is a reusable used paper sheet. This is because, if the user selects the de-colorable toner for the print job, the user usually expects to use used paper sheets.

The following scheme may also be adopted. The system CPU 51 may use a sensor, and the like, arranged around the cassette 15 to determine whether the paper sheet is a used reusable paper sheet. Specifically, the system CPU 51 may use a scanner or other sensors to detect traces of the de-colorable toner on the paper sheet.

Additionally, a mark may be printed at a prescribed area of a paper sheet only on the reusable used paper sheet. In this case, the system CPU 51 determines whether the paper sheet is the used reusable paper sheet based on whether the mark is detected.

If the system CPU 51 determines that the paper sheet for the print job is not a new paper sheet (NO in Act 32), the system CPU 51 records in the RAM 52 that the paper sheet for the print job is a reusable used paper sheet (Act 33). In addition, the system CPU 51 may command the NVM 54 to record information that the paper sheet to be used for the print job is a reusable used paper sheet.

If the RAM 52 records the information that the paper sheet to be used for the print job is a used reusable paper sheet, the system CPU 51 determines whether the jam occurrence number corresponding to the cassette 15 that accommodated the printed paper sheet is over the threshold corresponding to the cassette 15 (Act 34). The operation of Act 34 is the same as that of Act 17 in the first embodiment.

If the system CPU 51 determines that the jam occurrence number is over the threshold (YES in Act 34), the system CPU 51 commands the RAM 52 to record the information that the jam occurrence number corresponding to the cassette 15 is over the threshold (Act 35). In addition, the system CPU 51 may command the NMV 54 to record the information that the jam occurrence number corresponding to the cassette 15 is over the threshold.

If the RAM 52 records the information that the jam occurrence number is over the threshold, the system CPU 51 determines whether there is another cassette 15 that holds paper sheets of the same type (paper sheet size, media, and the like) as those of the cassette 15 that is selected in Act 32 (Act 36). Thus, the system CPU 51 determines whether paper sheets held in another cassette 15 can be substituted for the paper sheets held in the cassette 15 that is originally selected. For example, if the size of the paper sheets selected for the print job is A4 size, the system CPU 51 determines whether another cassette 15 holds paper sheets of the A4 size.

If the system CPU 51 determines that another cassette 15 holds paper sheets of the same type (YES in Act 36), the system CPU 51 switches the cassette 15 from which the paper sheet is to be fetched from the originally assigned cassette to the cassette 15 holding paper sheets of the same type as determined in Act 36 (Act 37).

If the cassette 15 is replaced, the system CPU 51 commands the RAM 52 to record the information regarding the replacement of the cassette and the number of the replaced cassette 15 (Act 38). In addition, the system CPU 51 may command the NVM 4 to record the above-mentioned information. Also, the system CPU 51 resets the information that the paper sheet is a used reusable paper sheet recorded in Act 33 and the information that the jam occurrence number is over the threshold recorded in Act 35.

After the information regarding the replacement of the cassette and the number of the replaced cassette 15 are recorded in the RAM 52, the system CPU 51 determines whether the paper sheets held in the replaced cassette are new paper sheets (Act 39).

If the system CPU 51 determines that the paper sheets held in the replaced cassette are not new paper sheets (NO in Act 39), the system CPU 51 commands the RAM 5 to record information that the paper sheets to be used for the print job are used reusable paper sheets (Act 40). Also, the system CPU 51 may command the NVM 54 to record information that the paper sheets to be used for the print job are used reusable paper sheets.

If the RAM 52 records information that the paper sheets to be used for the print job are used reusable paper sheets, the system CPU 51 determines whether the jam occurrence number corresponding to the replaced cassette 15 is over the threshold corresponding to the cassette 15 (Act 41).

If the system CPU 51 determines that the jam occurrence number corresponding to the new source cassette 15 is over the threshold (YES in Act 41), the system CPU 51 commands the RAM to record information that the jam occurrence number corresponding to the new source cassette 15 is over the threshold (Act 42). In addition, the system CPU 51 may also command the NVM 54 to record the information that the jam occurrence number corresponding to the new source cassette 15 is over the threshold.

The system CPU 51 commands the paper feeding section 30 to start feeding the paper sheets (Act 43) in the following cases: if the paper sheets to be used for the print job are new paper sheets (YES in Act 32); if the jam occurrence number is not over the threshold (NO in Act 34); if no cassette 15 can be substituted the originally-selected cassette (NO in Act 36); if the paper sheets held in the replaced cassette 15 are new paper sheets (YES in Act 39); if the jam occurrence number corresponding to the replaced cassette 15 is not over the threshold (NO in Act 41); and if the RAM 52 has recorded the information that the jam occurrence number is over the threshold (Act 42). The operation of Act 43 is the same as the operation in Act 11 in the first embodiment.

If the feeding of paper is started, the system CPU 51 determines whether a paper jam has occurred (Act 44). The operation in Act 44 is the same as that in Act 13 in the first embodiment.

If the system CPU 51 determines that a paper jam occurred (YES, Act 44), the system CPU 51 determines whether the RAM 52 (or the NVM 54) recorded the information that the paper sheet to be used for the print job is a used reusable paper sheet (Act 47).

If the system CPU 51 determines that the RAM 52 recorded the information (YES in Act 47), the system CPU 51 increments the jam occurrence number corresponding to the cassette 15 from which the paper sheets were fetched (Act 48). The operation of Act 48 is the same operation as that of the Act 16 in the first embodiment.

If the system CPU 51 determines that the RAM 52 recorded the information that the paper sheet is a used reusable paper sheet (NO in Act 47), or if the jam occurrence number is incremented (Act 48), the system CPU 51 determines whether the RAM 52 recorded the information regarding the replacement of the cassette (Act 49). If the system CPU 51 determines that the RAM 52 recorded the information (YES in Act 49), the system CPU 51 commands the operation panel 16 to display the information that the cassette used of the print job has been replaced and the cassette number of the replaced cassette 15 (Act 50). Thus, the system CPU 51 reads from the RAM 52 the information regarding the replacement of the cassette and the cassette number of the replaced cassette 15, and the system CPU commands the operation panel 16 to display the information. Also, the system CPU 51 may command display of the information that the jam occurrence number corresponding to the cassette 15 selected in Act 30 is over the prescribed threshold.

If the system CPU 51 determines that the RAM 52 did not record the replacement of the cassette (NO in Act 49), or if the operation panel 16 displayed the information regarding the replacement of the cassette 15 and the cassette number of the replaced cassette (Act 50), the system CPU 51 determines whether the RAM 52 recorded the information that the jam occurrence number is over the threshold (Act 51).

If the system CPU 51 determines that the RAM 52 recorded the information (YES in Act 51), the system CPU 51 commands the operation panel 16 to display the information that the jam occurrence number corresponding to the cassette 15 from which the paper sheet has been fed for the print job is over the threshold (Act 52). Thus, if the cassette 15 is not changed, the operation panel 16 displays the information that the jam occurrence number corresponding to the cassette 15 selected in Act 30 is over the threshold. Also, if the cassette 15 is changed, the operation panel 16 displays the information that the jam occurrence number corresponding to the replaced cassette 15 is over the threshold. In addition, the information displayed on the operation panel 16 may also be a message suggesting that the paper sheets in the cassette 15 be replaced or a message suggesting that another cassette 15 be selected for the print job. However, the contents of the information displayed on the operation panel 16 are not restricted.

If the system CPU 51 determines that the RAM 53 did not record the information that the jam occurrence number is over the threshold (NO in Act 51), or if the operation panel 16 displayed the information that the jam occurrence number is over the threshold (Act 52), the system CPU 51 determines whether the RAM 52 recorded the information that the paper sheets used for the print job are used reusable paper sheets (Act 53).

If the system CPU 51 determines that the RAM 52 did not record the information (NO in Act 53), the system CPU 51 commands the operation panel 16 to display the error message that the jammed paper sheet is a new paper sheet (Act 54). For example, the operation panel 16 may also display an error message that a paper jam occurred, the point of the paper jam, the scheme to handle the paper jam, and the like. However, the contents of the error message are not restricted.

If the system CPU 51 determines that the RAM 52 recorded the information that the paper sheet for the print job is the reusable used paper sheet (YES in Act 53), the system CPU 51 commands the operation panel 16 to display the error message that the jammed paper sheet is a reusable used paper sheet (Act 55). For example, as the error message, the operation panel 16 may display the error message that the jammed paper sheet is a used reusable paper sheet in addition to the error message displayed in Act 54. Also, the operation panel 16 may display the method for handling the paper jam of the reusable used paper sheet. However, the contents of the error message are not restricted.

If the operation panel 16 displays the error message corresponding to the new paper sheet or the error message corresponding to the reusable paper sheet (Act 54 or Act 55), the system CPU 51 determines whether the condition for recovering from the paper jam state is met (Act 56). The operation in Act 56 is the same as that in Act 20 in the first embodiment.

If the system CPU 51 determines that the condition for recovering from the paper jam state is not met (NO in Act 56), the system CPU 51 returns to Act 56, and the system CPU waits for the condition of the paper jam state to be resolved.

If the system CPU 51 determines that no paper jam has occurred (NO in Act 44), the system CPU 51 determines whether the RAM 52 recorded the information that the cassette used for the print job has been replaced (Act 45).

If the system CPU 51 determines that the RAM 52 recorded the information (YES in Act 45), the system CPU 51 commands the operation panel 16 to display the information regarding the replacement of the cassette 15 and the cassette number of the replaced cassette 15 (Act 46). The operation of Act 46 is the same as that of Act 50.

If the system CPU 51 determines that the RAM 52 did not record the information (NO in Act 45), or if the operation panel 16 displayed the replacement of the cassette (Act 46), the system CPU 51 determines whether the printing operation ends (Act 57). The operation of Act 57 is the same as that of Act 21 in the first embodiment.

If the system CPU 51 determines that the printing operation has not ended (NO in Act 57), or if the system CPU 51 determines that the condition for recovering from the paper jam state is met (YES in Act 56), the system CPU 51 returns to Act 32 for carrying out the printing operation again.

If the system CPU 51 determines that the printing operation has ended (YES in Act 57), the system CPU 51 ends the printing operation.

In addition, Act 34 may also include the operation of determining whether the ratio of the jam occurrence number with respect to the number of printing jobs is over a prescribed threshold or whether the ratio of the jam occurrence number of the cassette to be used for the print job is larger than that of another cassette. In this case, the system CPU 51 in Act 52 may also command the operation panel 16 to display the information that the ratio of the jam occurrence number is over the threshold or that the jam occurrence number is larger than that of another cassette.

Also, the system CPU 51 may command the operation panel 16 to display combinations of the information recorded in the RAM 52, i.e. the record that the paper sheet is a reusable paper sheet, the record that the cassette is replaced, and the record that the jam threshold has been exceeded. In addition, the operation panel 16 may display the information that the RAM 52 has not recorded the information.

Also, when the jam occurrence number corresponding to the replaced cassette 15 is over the threshold, the system CPU 51 may further re-select the cassette 15 to be used for the print job. The number of replacing the cassette 15 to be used for the print job is not restricted.

With the treatment, for the image forming apparatus, when the jam occurrence number becomes a prescribed number with respect to the cassette that holds the reusable used paper sheets, it is possible to automatically switch the cassette to be used for the print job. Also, the error message different from the conventional message can be displayed when the jammed paper sheet is a reusable used paper sheet. Here, for the image forming apparatus, when the jam occurrence number is over a prescribed number, the error message that the cassette that has held the jammed paper sheets tends to cause paper jams can be displayed.

While certain embodiments have been described, these embodiments have been presented by way of example only, and they are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a sheet conveyer;

a sensor configured to detect a trace of decolorable toner on a sheet conveyed by the sheet conveyer;

an image forming device configured to form an image on the sheet;

a display; and a controller configured to determine whether the sheet is a new sheet or a used sheet based on a detection result of the sensor, and control the display to selectively display a first jam message indicating that a jam of a new sheet has occurred and a second jam message indicating that a jam of a used sheet has occurred, based on the determination, when a sheet jam occurs.

2. The image forming apparatus according to claim 1, further comprising:

a data storage in which a first number representing how many times jams of used sheets have occurred is stored.

3. The image forming apparatus according to claim 2, wherein a second number representing how many times jams of used sheets are permitted to occur is also stored in the data storage, and the display is controlled to display the second jam message if the first number does not exceed the second number and display a third jam message that is different from the second jam message if the first number exceeds the second number.

4. The image forming apparatus according to claim 3, wherein the third jam message includes a message about replacement of sheets in a cassette.

5. The image forming apparatus according to claim 3, further comprising:

a plurality of cassettes, from one of which the sheet is conveyed to the image forming device, wherein the third jam message includes a message about switch of a cassette from which sheets are conveyed.

6. A method for carrying out sheet processing, comprising:

detecting a trace of decolorable toner on a sheet that is conveyed;

determining whether the sheet is a new sheet or a used sheet based on detection of the trace;

detecting a sheet jam; and after the sheet jam is detected, displaying a first jam message indicating that a jam of a new sheet has occurred when the sheet is determined to be a new sheet, and a second jam message indicating that a jam of a used sheet has occurred when the sheet is determined to be a used sheet.

7. The method according to claim 6, further comprising:

storing, in a data storage, a first number representing how many times jams of used sheets have occurred.

8. The method according to claim 7, further comprising:

storing, in the data storage, a second number representing how many times jams of used sheet are permitted to occur.

9. The method according to claim 8, further comprising:

displaying a third jam message that is different from the second jam message, when the first number exceeds the second number, wherein the second jam message is displayed when the first number does not exceed the second number.

10. The method according to claim 9, wherein the third jam message includes a message about replacement of sheets in a cassette.

11. The method according to claim 9, wherein the third jam message includes a message about switch of a cassette from which sheets are conveyed.

* * * * *